US008089444B2

(12) United States Patent
Kim et al.

(10) Patent No.: US 8,089,444 B2
(45) Date of Patent: Jan. 3, 2012

(54) LIQUID CRYSTAL DISPLAY AND MEMORY CONTROLLING METHOD THEREOF

(75) Inventors: Jingsung Kim, Kyungbuk (KR); Hayoung Ji, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 581 days.

(21) Appl. No.: 12/318,208

(22) Filed: Dec. 23, 2008

(65) Prior Publication Data

US 2010/0066726 A1 Mar. 18, 2010

(30) Foreign Application Priority Data

Sep. 17, 2008 (KR) ..... 10-2008-0091093

(51) Int. Cl.
*G09G 3/36* (2006.01)

(52) U.S. Cl. ..... 345/90; 345/204

(58) Field of Classification Search ..... 345/87, 345/89, 90, 94, 98–100, 204, 214
See application file for complete search history.

(56) References Cited

U.S. PATENT DOCUMENTS

| | | | | |
|---|---|---|---|---|
| 5,146,211 | A * | 9/1992 | Adams et al. | 715/856 |
| 5,361,081 | A * | 11/1994 | Barnaby | 715/857 |
| 7,835,343 | B1 * | 11/2010 | Reibel | 370/350 |
| 2003/0194199 | A1 * | 10/2003 | Roth | 386/46 |
| 2007/0066311 | A1 * | 3/2007 | Reibel et al. | 455/445 |

* cited by examiner

*Primary Examiner* — Ricardo L Osorio
(74) *Attorney, Agent, or Firm* — Morgan, Lewis & Bockius LLP

(57) ABSTRACT

A display device including a display panel having a plurality of data lines and a plurality of gate lines disposed cross-wisely, a timing controller, the timing controller including a data comparing and blank time detecting device comparing whether current data and previous data are same and detecting a blank time in which no data inputs to generate a flag signal for indicating the blank time and a data keeping time in which a data same with the previous data is inputted, a memory control signal generator generating a memory clock, and stopping the generation of the memory clock when the flag signal is generated, a memory which is operated by the memory clock intermittently by the flag signal, and a data synchronizer delaying the data in time for treating operation of the data comparing and blank time detecting device and the memory control signal generator to synchronize the data inputted to the memory with the memory clock, and a data drive circuit converting data from the memory into a data voltage and supplying to the data lines, and a gate drive circuit supplying a scan pulse to the gate lines.

10 Claims, 6 Drawing Sheets

LIQUID CRYSTAL DISPLAY AND MEMORY CONTROLLING METHOD THEREOF

This present invention claims the benefit of Korean Patent Application No. 10-2008-0091093 filed on Sep. 17, 2008, which is hereby incorporated by reference.

BACKGROUND OF THE INVENTION

1. Field of the Invention

The present invention relates to a liquid crystal display (LCD) and, more particularly, to an LCD device and memory controlling method thereof in which the consumption of electric power of a timing controller is reduced.

2. Discussion of the Related Art

The active matrix type liquid crystal display device ("LCD device") represents video data using the thin film transistor ("TFT") as the switching element. The liquid crystal display device is smaller than the cathode ray tube ("CRT") so that it is easily used as the display device for a portable information device, office automation device, computer, etc. Furthermore, use of the LCD device in television displays has rapidly grown, and the LCD device essentially is replacing the CRT.

The LCD device includes a liquid crystal display panel, a drive circuit for driving the LCD panel, and a timing controller for controlling the drive circuit. The timing controller receives the digital video data, stores it to memory, reads the stored data from the memory, and then transmits the data to the drive circuit.

The memory of the timing controller writes and reads digital video data according to the memory clock. The memory clock is continuously toggling in high frequency during the period in which the digital video data to be shown on the LCD panel is received and during the blank time. Due to the memory clock continuously toggling with high frequency, the timing controller consumes significant electric current, and consumption of electric power is increased. Furthermore, the memory clock continuously toggling may cause the timing controller to overheat such that the reliability of the timing controller will be degraded. In addition, it is hard to individually control a plurality of memory with the memory clock continuously toggling.

SUMMARY OF THE INVENTION

Accordingly, the present invention is directed to a liquid crystal display and memory controlling method thereof that substantially obviates one or more of the problems due to limitations and disadvantages of the related art.

Embodiments object of the present invention provide a liquid crystal display device and memory controlling method of the LCD device in which the consumption of electric current is reduced.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display and memory controlling method thereof includes a timing controller comprising a data comparing and blank time detecting device comparing whether current data and previous data are same and detecting a blank time in which no data is inputted to generate a flag signal for indicating the blank time and a data keeping time in which data same with the previous data is inputted, a memory control signal generator generating a memory clock, and stopping the generation of the memory clock when the flag signal is generated, a memory which is operated by the memory clock intermittently by the flag signal, and a data synchronizer delaying the data in time for treating operation of the data comparing and blank time detecting device and the memory control signal generator to synchronize the data inputted to the memory with the memory clock.

In another aspect, the liquid crystal display and memory controlling method thereof includes a display device comprising a display panel having a plurality of data lines and a plurality of gate lines disposed cross-wisely, a timing controller, the timing controller including a data comparing and blank time detecting device comparing whether current data and previous data are same and detecting a blank time in which no data inputs to generate a flag signal for indicating the blank time and a data keeping time in which a data same with the previous data is inputted, a memory control signal generator generating a memory clock, and stopping the generation of the memory clock when the flag signal is generated, a memory which is operated by the memory clock intermittently by the flag signal, and a data synchronizer delaying the data in time for treating operation of the data comparing and blank time detecting device and the memory control signal generator to synchronize the data inputted to the memory with the memory clock, and a data drive circuit converting data from the memory into a data voltage and supplying to the data lines, and a gate drive circuit supplying a scan pulse to the gate lines.

In another aspect, the liquid crystal display and memory controlling method thereof includes a method for operating a timing control circuit of a liquid crystal display device comprising the steps of comparing input digital video data with previously stored digital video data, instructing a memory controller of a timing control circuit not to generate a memory clock signal when the input digital video data and previously stored digital video data are the same, and detecting blank time when the input digital video data and previously stored digital video are different, wherein if blank time is detected, the memory controller is instructed not to generate a memory clock signal, and if blank time is not detected the memory controller is instructed to generate a memory clock signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

The liquid crystal display device and memory controlling method thereof will now be described in detail with reference to the accompanying drawings. With reference to FIGS. 1 through 7, the present invention will be explained.

Figure 1:
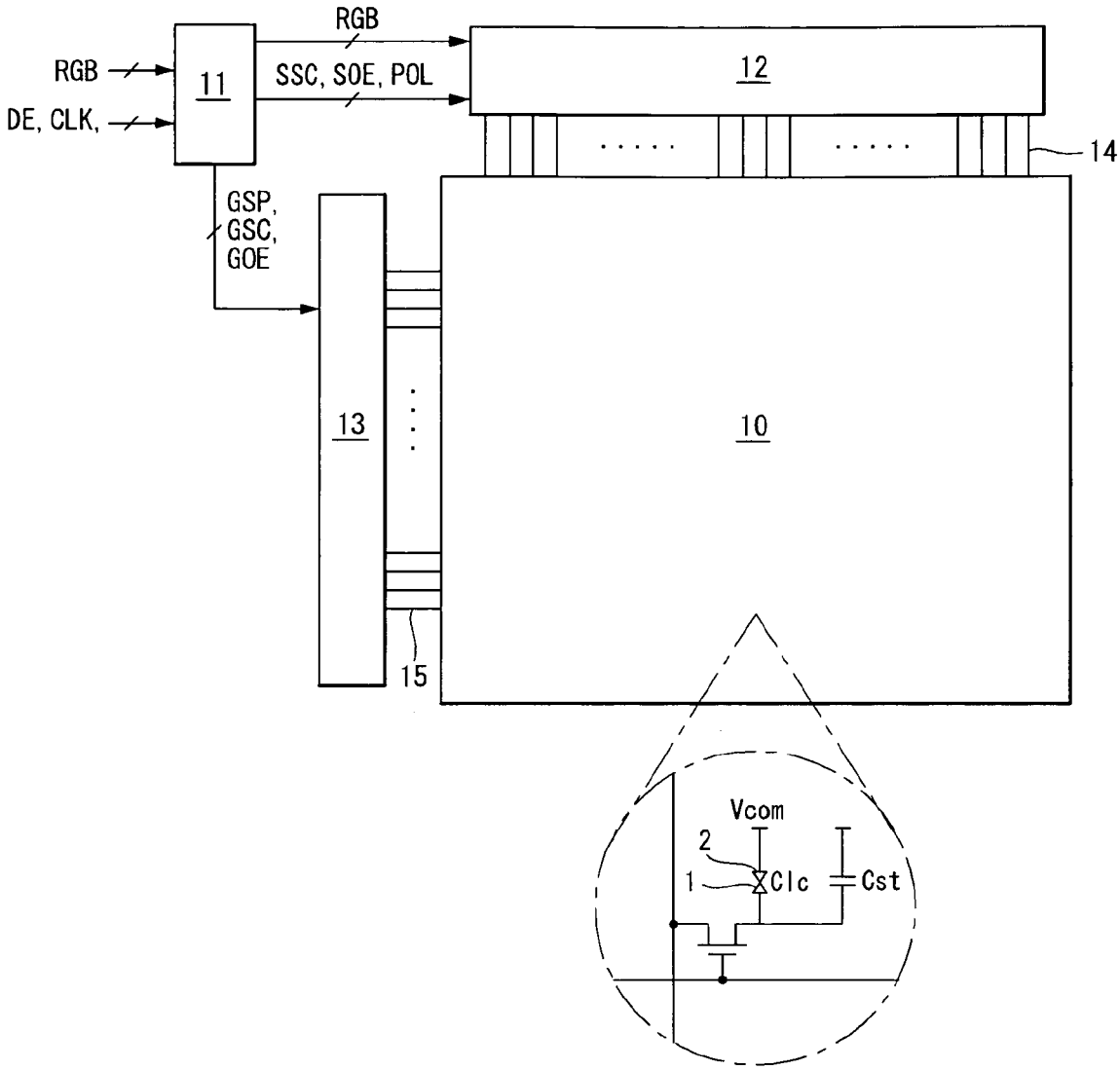
FIG. 1 is a block diagram illustrating a liquid crystal display device according to the present invention.

Referring to FIG. 1, the liquid crystal display device according to the present invention includes a liquid crystal display panel ("LCD panel") 10, timing controller 11, data drive circuit 12, and gate drive circuit 13.

The data drive circuit 12 includes a plurality of source drive integrated circuits (ICs). The gate drive circuit 13 includes a plurality of gate drive ICs.

The LCD panel 10 has two glass substrates and a liquid crystal layer inserted therebetween. The LCD panel 10 includes data lines 14 and gate lines 15 disposed crosswisely and liquid crystal cells (Clc) disposed in a matrix type according to the crossed structure of data lines 14 and gate lines 15.

The lower glass substrate of the liquid crystal display panel 10 includes data lines 14, gate lines 15, TFTs, and storage capacitors (Cst). The liquid crystal cells (Clc) are connected to the TFTs and are driven by the electric field formed at pixel electrode 1 and the common electrode 2. The upper glass substrate of the liquid crystal display panel 10 may include a black matrix, color filter, and common electrode 2. The common electrode 2 may be formed on the upper glass substrate for the vertical electric field driving type, such as TN mode (Twisted Nematic mode) and VA mode (Vertical Alignment mode). On the contrary, for the horizontal electric field driving type, such as IPS mode (In-Plane Switching mode) and FFS mode (Fringe Field Switching mode), the common electrode 2 may be formed on the lower glass substrate with the pixel electrode 1.

On the outer surfaces of the upper and lower glass substrates of the liquid crystal display panel 10, polarization plates are attached (not shown). On the inner surface of the upper and lower glass substrate of the liquid crystal display panel 10, alignment layers for pre-tilt angle of the liquid crystal material are formed.

The timing controller 11 supplies the digital video data (RGB) to the data drive circuit 12. Furthermore, the timing controller 11 receives the timing signal such as the data enable (DE) signal and the clock (CLK), and generates the control signal for controlling the operating timing of the data drive circuit 12 and the gate drive circuit 13. The timing controller 11 counts the data enable signal (DE) to distinguish 1 frame period and 1 horizontal period. The timing signal of the timing controller 11 includes the vertical synchronizing signal (Vsync) and the horizontal synchronizing signal (Hsync). The control signal for controlling the operating timing of the data and gate drive circuits 12 and 13 includes the gate timing controlling signal for controlling the operating timing of the gate drive circuit 13 as well as the data timing control signal for controlling the operating timing of the data drive circuit 12 and the polarity of data voltage.

The timing controller 11 writes the input digital video data to the memory, and then reads the data in the memory again, and then rearranges the digital video data (RGB) supplied to the data drive circuit 12. The timing controller 11 compares the neighboring data in the pixel unit. When data that is the same as the previous data is inputted, and during the blank time in which no valid data is inputted, the timing controller 11 does not generate the memory clock. Therefore, the embedded memory in the timing controller 11 does not perform the write and read operations when data that is the same as the previous data is inputted or when the blank signal is inputted. That is, the embedded memory of the timing controller 11 does not write and read the new data currently inputted, but reads the data stored previously during the same data hold time in which data that is the same as the previous data is inputted or when the blank signal is inputted.

When data that is different from the previous data is inputted or during the data enable period in which valid data is shown on the liquid crystal display panel 10, the timing controller 11 generates the memory clock signal to activate the write and read operations of the memory.

The gate timing control signal generated from the timing controller 11 includes the gate start pulse (GSP), gate shift clock (GSC), gate output enable signals (GOE1 to GOE3), and so on. The gate start pulse (GSP) is supplied to the gate drive IC generating the first gate pulse (or scan pulse). The gate shift clock (GSC), as the clock signal commonly inputted into the gate drive ICs, is the clock signal for shifting the gate start pulse (GSP). The gate output enable signal (GOE) controls the outputs of the gate drive ICs.

The data timing control signal generated from the timing controller 11 includes the source sampling clock (SSC), polarity control signal (POL), source output enable signal SOE, and so on. The source sampling clock (SSC) is the clock signal for controlling the sampling operation of the data in the data drive circuit 12 based on the rising or falling edge. The polarity control signal (POL) controls the vertical polarity of the data voltage outputted from the source output enable signal (SOE). The source output enable signal (SOE) controls the output of the data drive circuit 12.

Figure 5:
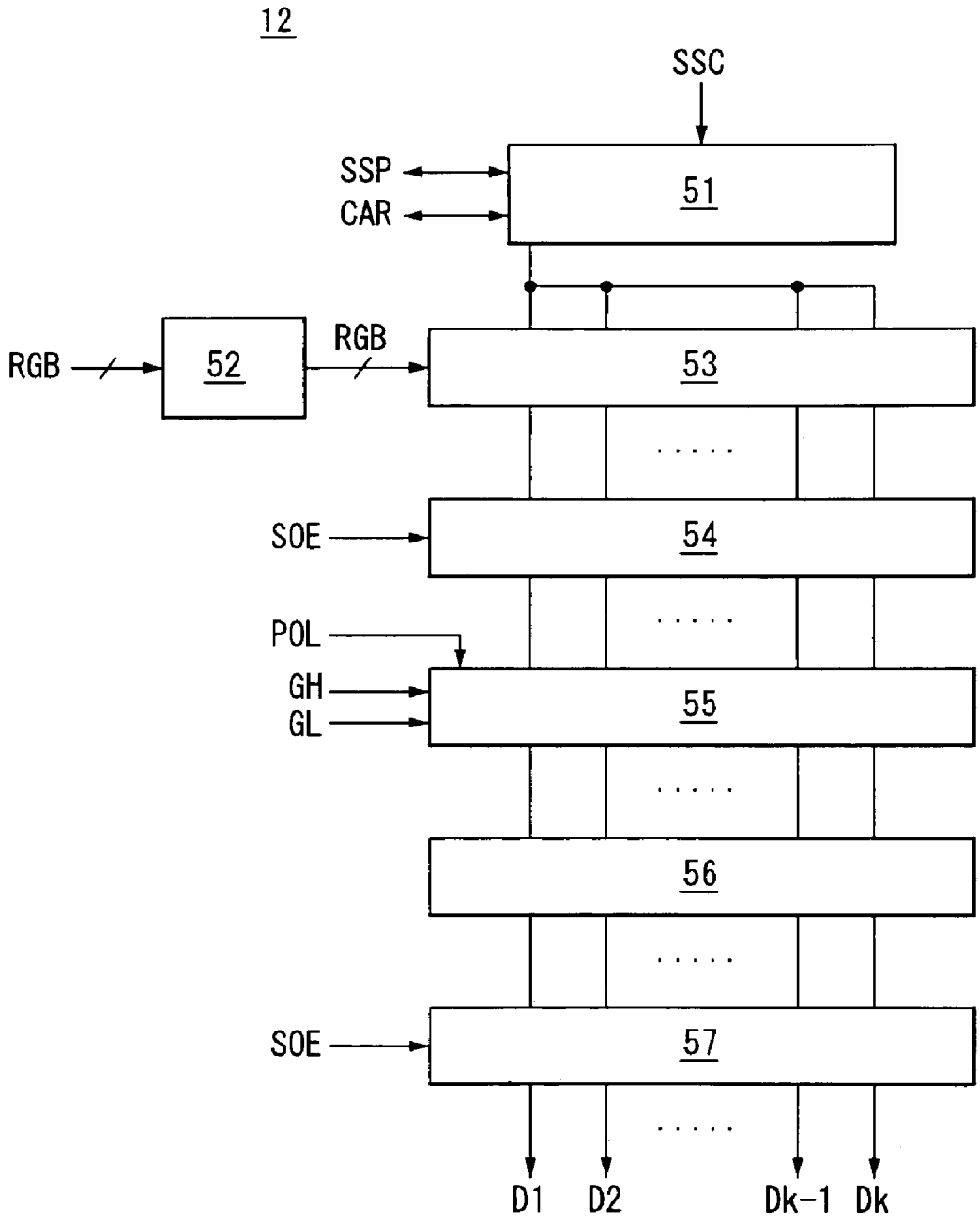
FIG. 5 is a block diagram illustrating the circuit configuration of the data drive circuit shown in FIG. 1.

Each of data drive ICs of the data drive circuit 12 includes the shift register, latch, digital-analog converter, output buffer, and so on, as shown in FIG. 5 (which will be described later). The data drive circuit 12 latches the digital video data (RGB) under the control of the timing controller 11. In addition, the data drive circuit 12 converts the digital video data (RGB) into the analog positive/negative gamma compensation voltage according to the polarity control signal (POL), and generates the positive/negative analog data voltages, and supplies these data voltages to the data lines 14.

Figure 6:
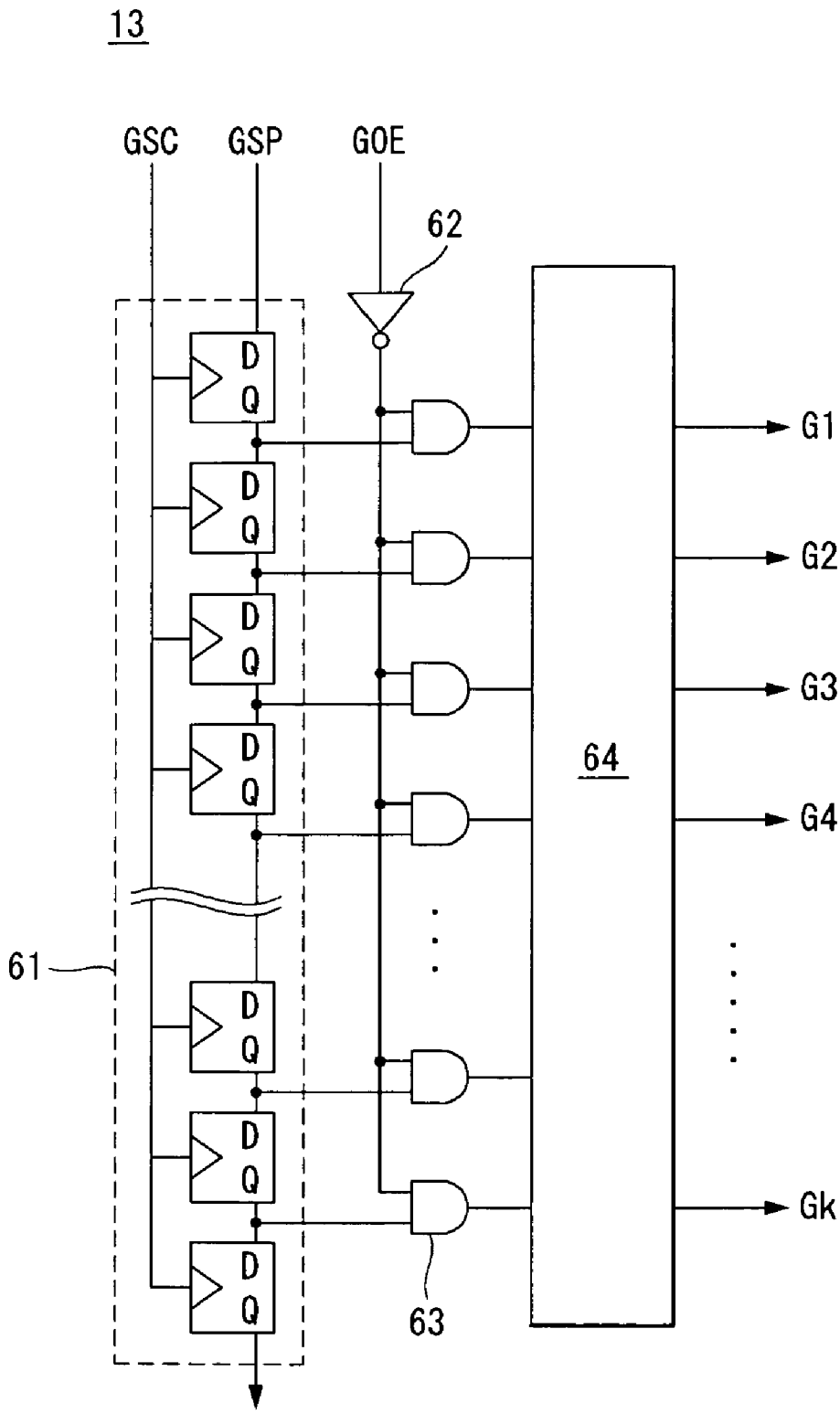
FIG. 6 is a block diagram illustrating the circuit configuration of the gate drive circuit shown in FIG. 1.

The gate drive circuit 13 includes the shift register, AND gate, level shifter, output buffer, and so on, as shown in FIG. 6 (which will be described later). The gate drive circuit 13 sequentially supplies the gate pulse to the gate lines 15 in response to the gate timing control signal.

Figure 2:
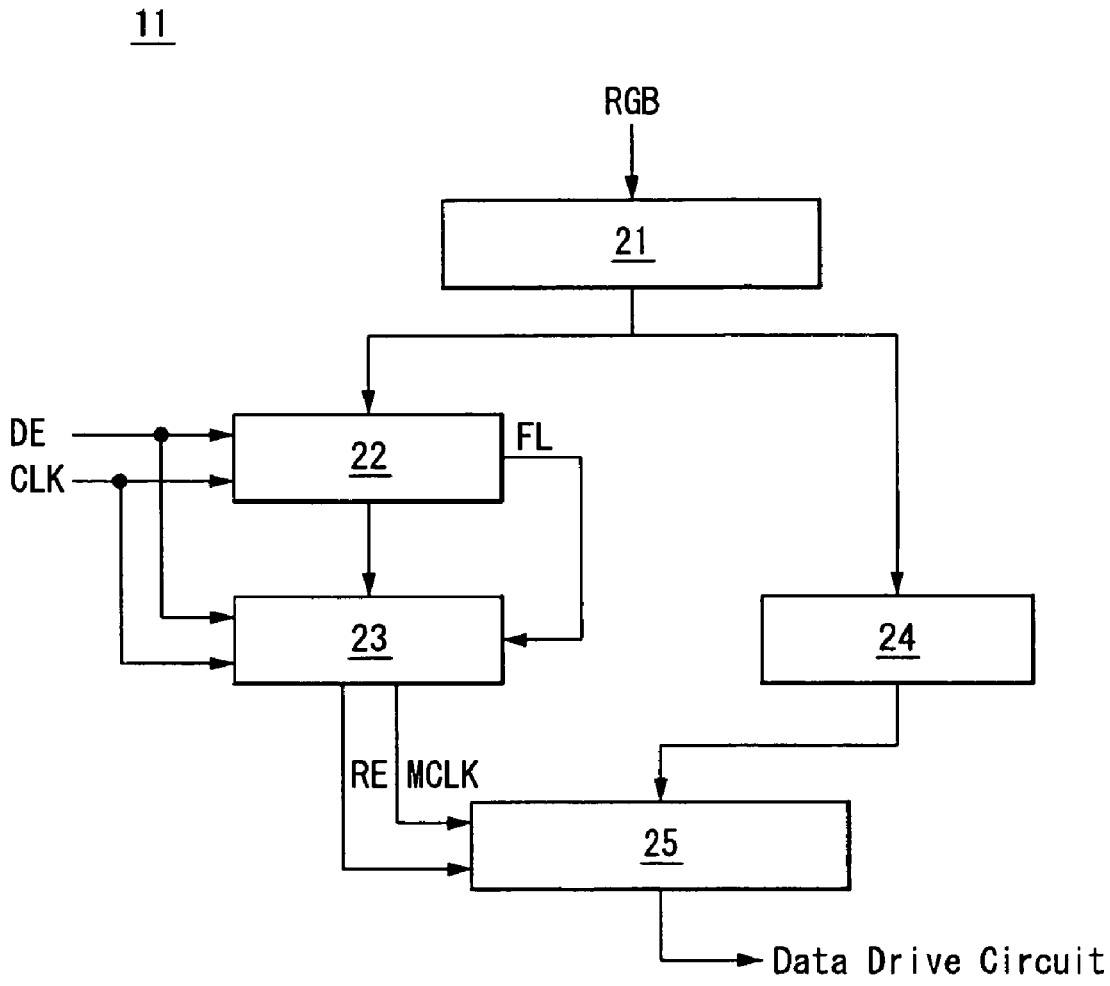
FIG. 2 is a block diagram illustrating a memory controller of the timing controller shown in FIG. 1.

FIG. 2 illustrates the memory controller of the timing controller 11. Referring to FIG. 2, the memory controller of the timing controller 11 includes the data input part 21, data comparing and blank time detecting device 22, memory control signal generator 23, data synchronizer 24, and memory 25.

The data input part 21 arranges the digital video data (RGB) inputted from the scalar of system through the interface circuit, such as low-voltage differential signaling ("LVDS") interface, according to the predetermined array type and supplies the data comparing and blank time detecting device 22 and data synchronizer 24.

The data comparing and blank time detecting part 22 receives the timing signals such as the data enable signal (DE) and clock (CLK), as well as the digital video data from the data input part 21. The data comparing and blank time detecting device 22 compares the previous data stored in the register with the current data inputted at this time, and decides if they are same or not. In addition, the data comparing and blank time detecting part 22 detects the blank time having no valid digital video data input according to the data enable signal (DE). According to the comparison result, the data comparing and blank time detecting device 22 generates the flag signal (FL) indicating the same data hold time in which data that is the same as the previous data inputted or blank time.

The memory control signal generator 23 generates the read enable signal (RE) for controlling the memory 25 and the memory clock signal (MCLK). The read enable signal (RE) indicates the read time of memory 25. The memory clock signal (MCLK) is the clock signal for indicating the sampling operation of each data at the writing and reading operation of the memory 25. The memory control signal generator 23 receives the flag signal (FL) and the clock signal (CLK) and generates toggling signals having the same frequency with the clock signal (CLK) during specified logic period of the flag signal (FL), and, during the period of the same data hold time or blank time, does not generate the toggling signal but generates the memory clock signal (MCLK) being at the low logic level.

For example, the memory control signal generator 23 performs the logical multiple operation ("AND operation") to the reversed flag signal (FL) and the clock signal (CLK), and generates the memory clock signal (MCLK) toggling during low logic period of the flag signal (FL) and maintaining the low logic during high logic period of the flag signal (FL). The memory control signal generator 23 may further generate the write enable signal indicating the writing time of the memory.

The data synchronizer 24 holds the digital video data for the time period during the operation of the data comparing and blank time detecting device 22 and the memory control signal generator 23 operate to synchronize the digital video data (RGB) with the memory control signals (RE and MCKL) inputted to the memory.

The memory 25 stores the digital video data under the control of the memory control signal generator 23 and supplies it to the data drive circuit 12. The memory 25 may include 4 line memories. The 4 line memories write the data for high logic period of data enable signal (DE) and read the stored data for low logic period of the read enable signal (RE). While two line memories are writing data, the other two line memories read data.

The memory 25 reads or writes the digital video data according to the memory clock (MCLK). The memory clock (MCLK) is inactivated during the same data hold time or blank time by the flag signal (FL) to keep low logic. Therefore, each line of the memory 25 is inactive during the same data hold time and blank time and does not write or read data. For the other time period, that is, when the valid data is different from the previous data inputted, each line of the memory 25 is activated to read and write the data.

Figure 3:
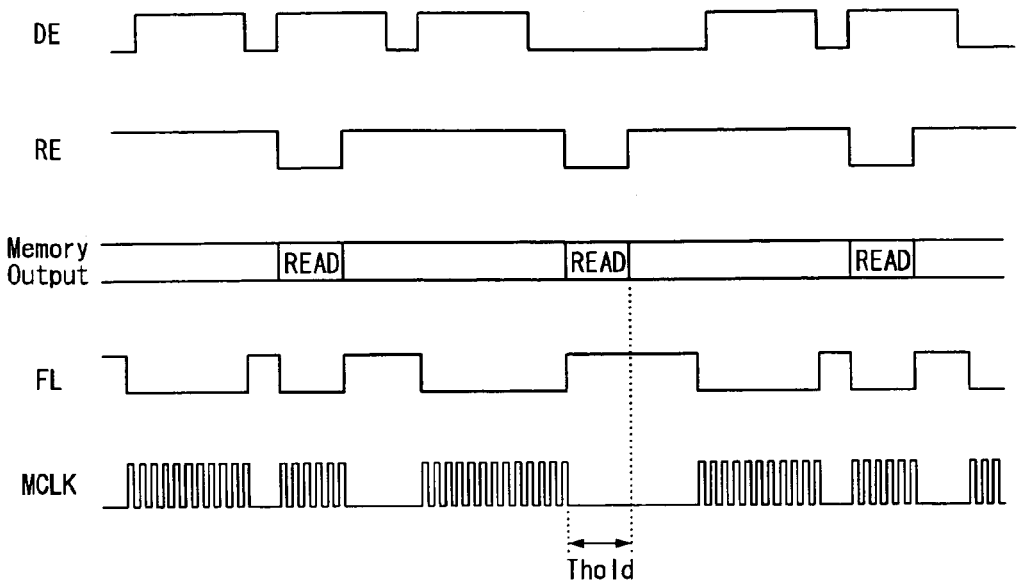
FIG. 3 is a waveform diagram illustrating memory control signals.
Figure 4:
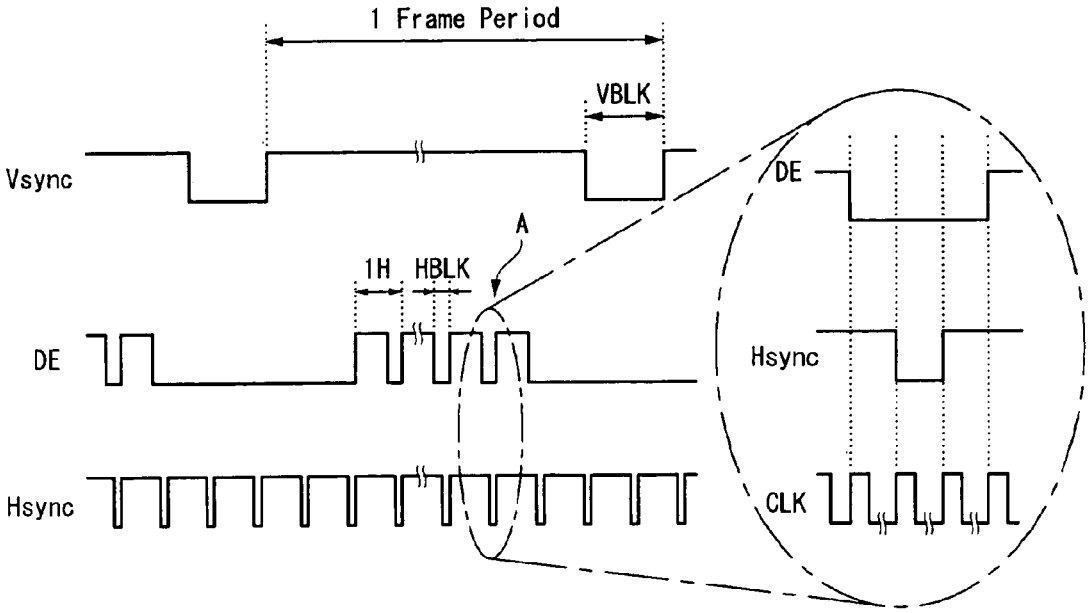
FIG. 4 is a waveform diagram illustrating blank time.

FIG. 3 is a waveform diagram illustrating the memory control signals (RE and FL). Referring to FIG. 3, the memory 25 reads data from line memories during low logic period of the read enable signal (RE) according to the memory clock (MCLK).

The memory clock signal (MCLK) is not toggling during the same data hold time ("Thold") and blank time. The blank time includes the horizontal blank time (HBLK) (FIG. 4) corresponding to the low logic period which does not have data between clocks of data enable signal (DE) generated with the frequency of 1 horizontal period, and the vertical blank time (VBLK) (FIG. 4) which does not have input of data between frame periods. When there is no vertical synchronization signal input, the memory controller counts the data enable signal (DE) to decide a time period in which the data enable signal (DE) is not inputted for the time period as the blank time.

"Thold" is the same data hold time in which the current data is decided as the same with the previous data. During the same data hold time (Thold) and the blank time (HBLK and VBLK), the data comparing and blank time detecting device 22 generates the flag signal (FL) to keep the memory clock (MCLK) in low logic. Therefore, the lines of the memory 25 do not read the data currently inputted because the memory clock (MCLK) is not received even the read enable signal (RE) is applied. That is, the lines of the memory 25 do not write and read for the current data during the same data hold time (Thold) and blank time (HBLK and VBLK), but read the previous data stored in the lines.

In the interim, for writing and reading the data delayed in the memory controller, the memory clock (MCLK) may be generated during some period of blank time.

FIG. 5 illustrates the data drive circuit 12 in detail. Referring to FIG. 5, the data drive circuit 12 includes a plurality of ICs, wherein each of the ICs drives the k data lines (D1 to Dk). Each of the ICs includes a shift register 51, data register 52, first latch 53, second latch 54, digital/analog converter (or "DAC") 55, output circuit 56, and charge share circuit 57.

The shift register 51 generates the sampling signal by shifting the source start pulse (SSP) from the timing controller 11 according to the source sampling clock (SSC). Further, the shift register 51 shifts the source start pulse (SSP) and transmits the carrier signal (CAR) to the shift register 51 of the next IC. The data register 52 temporarily stores the digital video data (RGB) from the timing controller 11, and supplies the stored digital video data (RGB) to the first latch 53. The first latch 53 performs the sampling to the digital video data (RGB) from the data register 52 in response to the sampling signal sequentially received from the shift register 51 and latches them, and then outputs data at the same time. The second latch 54 holds the data received from the first latch 53, and then outputs the latched digital video data with the second latch 54 of other ICs at the same time during the low logic period of source output enable signal (SOE). DAC 55 converts the digital video data from the second latch 54 into the positive gamma compensation voltage (GH) or the negative gamma compensation voltage (GL) in response to the polarity control signal (POL) to make analog positive/negative data voltages. The output circuit 56 minimizes the signal damping of the analog data voltage supplied to the buffer and the data line (D1 to Dk). The charge share circuit 57 supplies the charge share voltage or the common voltage (Vcom) to the data lines (D1 to Dk) by synchronizing to the high logic period of the source output enable signal (SOE).

FIG. 6 illustrates the gate IC of the gate drive circuit 13. Referring to FIG. 6, the gate IC of the gate drive circuit 13 includes the shift register 61, level shifter 64, and a plurality of AND gate 63 connected between the shift register 61 and the level shifter 64.

The shift register 61 sequentially shifts the gate start pulse (GSP) according to the gate shift clock (GSC) using a plurality of D-filpflop serially connected. Each of AND gates 63 generates the output by performing AND operation to the non-reversed output signal of the D-flipflop and the reversed signal of the gate output enable signal (GOE). The gate output enable signal (GOE) is reversed by the inverter 62 and then supplied to one input terminal of the AND gate 63. The level shifter 64 shifts the output voltage swing width of the AND gate 63 to the swing width which can operate the TFT of the LCD panel. The output signal (G1 to Gk) of the level shifter 64 is sequentially supplied to the k gate lines. The gate drive circuit 13 may be formed on the glass substrate of the LCD panel 10 with the TFT array. In this case, the level shifter 64 is formed on printed circuit board ("PCB"), and the shift register for shifting the output voltage of the level shifter 64 is formed on the glass substrate of the LCD panel 10.

Figure 7:
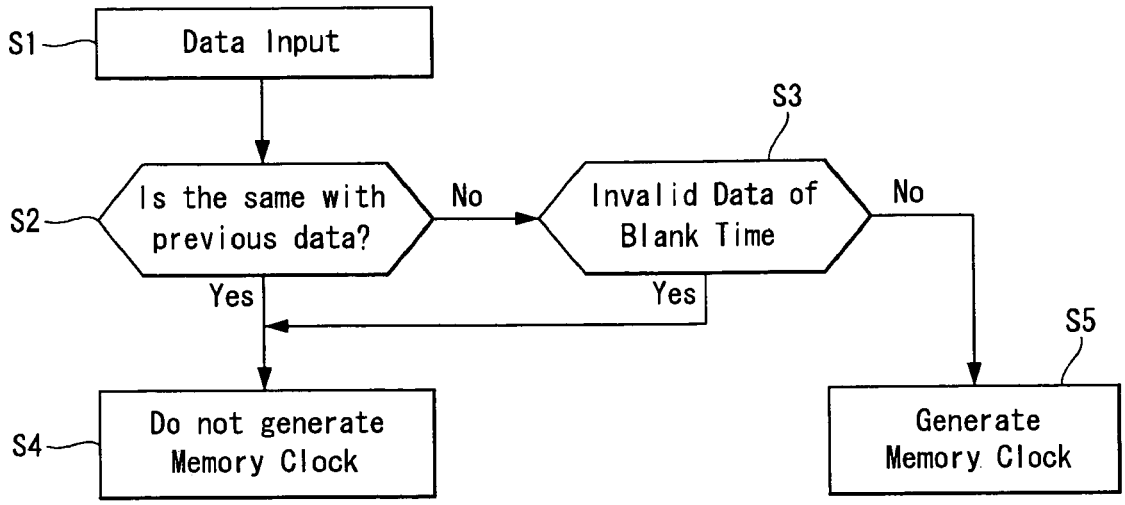
FIG. 7 is a flow chart illustrating the controlling steps of the memory controlling method of the liquid crystal display device according to the present invention.

FIG. 7 is the flow chart illustrating the memory controlling method of the liquid crystal display device according to the present invention.

The memory controller of the timing controller 11 compares the digital video data currently inputted with the previous data stored in the register, and then decides if they are same or not (Steps S1 and S2). If the current data is the same as the previous data, the memory controller does not generate the memory clock (MCLK) (Step S4). At this time, the memory does not store the current data and holds the previous data.

In addition, the memory controller of the timing controller 11 detects blank time based on the timing signals, and does not generate the memory clock (MCLK) during the blank time (Step S4).

The timing controller 11 generates the memory clock (MCLK) during the data receiving time period except the same data hold time and blank time, that is, when valid data is inputted that is different from the previous data inputted. As a result, the timing controller 11 activates the writing and reading operation to the current data (Step S5).

The liquid crystal display device and the memory controlling method of the LCD device stop to generate the memory clock during the same data hold time and blank time. As a result, the present invention provides a device and method for reducing the consumption of electric current by the timing controller. As a result, overheating of the timing controllers is reduced as well.

It will be apparent to those skilled in the art that various modifications and variations can be made in the liquid crystal display and memory controlling method thereof of the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel having a plurality of data lines and a plurality of gate lines disposed cross-wisely;

a timing controller, the timing controller including:

a data comparing and blank time detecting device comparing whether current data and previous data are same and detecting a blank time in which no data inputs to generate a flag signal for indicating the blank time and a data keeping time in which a data same with the previous data is inputted, a memory control signal generator generating a memory clock, and stopping the generation of the memory clock when the flag signal is generated, a memory which is operated by the memory clock intermittently by the flag signal, and a data synchronizer delaying the data in time for treating operation of the data comparing and blank time detecting device and the memory control signal generator to synchronize the data inputted to the memory with the memory clock; and a data drive circuit converting data from the memory into a data voltage and supplying to the data lines; and a gate drive circuit supplying a scan pulse to the gate lines.

2. The display device according to claim 1 wherein the data comparing and blank time detecting device detects the blank time based on a data enable signal.

3. The display device according to claim 1, wherein the blank time includes a horizontal blank time between pulses of the data enable signal and a vertical blank time between frame periods in which the data enable signal is not inputted for certain time period.

4. The display device according to claim 1 wherein the memory outputs the previous data except when writing and reading the current data.

5. The display device according to claim 1 wherein a memory clock signal is not toggling during blank time and when the previous data is the same as the current data.

6. A method for operating a timing control circuit of a liquid crystal display device comprising the steps of:

comparing input digital video data with previously stored digital video data;

instructing a memory controller of a timing control circuit not to generate a memory clock signal when the input digital video data and previously stored digital video data are the same, and detecting blank time when the input digital video data and previously stored digital video are different, wherein if blank time is detected, the memory controller is instructed not to generate a memory clock signal, and if blank time is not detected the memory controller is instructed to generate a memory clock signal.

7. The method according to claim 6 further comprising the step of synchronizing the input digital video data to the memory with the memory clock.

8. The method according to claim 6 wherein the blank time is based on a data enable signal.

9. The method according to claim 6 wherein the blank time includes a horizontal blank time between pulses of the data enable signal and a vertical blank time between frame periods in which the data enable signal is not inputted for certain time period.

10. The method according to claim 6 wherein a memory clock signal is not toggling during blank time and when the previous data is the same as the current data.

* * * * *